US009293874B2

(12) United States Patent
Morley et al.

(10) Patent No.: US 9,293,874 B2
(45) Date of Patent: Mar. 22, 2016

(54) HIGH SPEED RADIO FREQUENCY CONNECTOR

(71) Applicant: Tyco Electronics Corporation, Berwyn, PA (US)

(72) Inventors: Stephen Thomas Morley, Manheim, PA (US); Steven Mead DeVore, Waterford, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/307,188

(22) Filed: Jun. 17, 2014

(65) Prior Publication Data

US 2015/0364879 A1 Dec. 17, 2015

(51) Int. Cl.

| | |
|---|---|
| ***H01R 12/00*** | (2006.01) |
| ***H01R 24/40*** | (2011.01) |
| *H01R 103/00* | (2006.01) |

(52) U.S. Cl.

CPC ..... *H01R 24/40* (2013.01); *H01R 2103/00* (2013.01)

(58) Field of Classification Search

CPC ..... H01R 23/6873; H01R 23/688; H01R 23/7073; H01R 13/65807

USPC ..... 439/578, 55, 63, 108, 607.05, 607.1

See application file for complete search history.

(56) References Cited

U.S. PATENT DOCUMENTS 4,707,040 A * 11/1987 Hansel, III ..... H01R 13/65807 439/510
5,618,202 A * 4/1997 Okuyama ..... H01R 23/662 439/497
5,720,620 A 2/1998 Nobe et al.
6,824,427 B1 * 11/2004 Feldman et al. ..... 439/581
7,384,306 B2 * 6/2008 Malstrom ..... H01R 13/65807 439/394
7,607,944 B2 * 10/2009 Yoshioka ..... H01R 12/598 439/579
7,850,489 B1 * 12/2010 Feldman et al. ..... 439/607.1
8,313,354 B2 * 11/2012 McAlonis et al. ..... 439/884

(Continued)

FOREIGN PATENT DOCUMENTS

| | | |
|---|---|---|
| DE | 44 10 047 A1 | 10/1994 |
| DE | 44 25 466 A1 | 1/1996 |
| EP | 1 174 948 A1 | 1/2002 |

OTHER PUBLICATIONS

Zoya Popovic, Sebastien Rondineau, Dejan Filipovic, PolyStrata Technology: an enabling new 3D architecture for microwave components and systems; University of Colorado, Boulder Blacksburg, VA 24060.

(Continued)

*Primary Examiner* — Neil Abrams
*Assistant Examiner* — Travis Chambers

(57) ABSTRACT

A coaxial connector system includes a first coaxial connector having a first center contact and at least one outer contact segment. The coaxial connector system includes a second coaxial connector mated with the first coaxial connector. The second coaxial connector has a second center contact terminated to the first rectangular center contact. The second coaxial connector has at least one outer contact segment mechanically and electrically connected to the at least one outer contact segment of the first coaxial connector. The at least one outer contact segment of the first coaxial connector and the at least one outer contact segment of the second coaxial connector form a rectangular shaped outer contact box that peripherally surrounds the first and second center contacts

20 Claims, 4 Drawing Sheets

(56) References Cited

U.S. PATENT DOCUMENTS

| | | | | |
|---|---|---|---|---|
| 2004/0161972 | A1* | 8/2004 | Laub | H01R 9/0503 439/585 |
| 2007/0197095 | A1* | 8/2007 | Feldman et al. | 439/608 |
| 2008/0026612 | A1* | 1/2008 | Malstrom | H01R 13/65807 439/79 |
| 2009/0280681 | A1* | 11/2009 | Mongold | 439/578 |
| 2011/0034075 | A1* | 2/2011 | Feldman et al. | 439/607.01 |

OTHER PUBLICATIONS

PolyStrata Process Radio Frequency Components; Electronic Materials; Packaging and Finishing Technologies; ; Rohm and Haas Electronic Material, LLC.; Feb. 2007.

Si-Pak Hermetic Packaging Technology; Rohm and Haas, and Rohm and Haas Electronic Materials; Philadelphia, PA ; Mar. 2007.

International Search Report, International Application No. PCT/US2015/032580, International Filing Date, May 27, 2015.

* cited by examiner

HIGH SPEED RADIO FREQUENCY CONNECTOR

BACKGROUND OF THE INVENTION

The subject matter herein relates generally to radio frequency connectors.

Due to their favorable electrical characteristics, coaxial cables and connectors have grown in popularity for interconnecting electronic devices and peripheral systems. A typical application utilizing coaxial cable connectors is a radio frequency (RF) application having RF connectors designed to work at radio frequencies in the UHF, VHF, and/or microwave range. Typically, a header connector is mounted to a substrate, such as a circuit board, or alternatively, the header connector is terminated to an end of one or more cables. A corresponding mating connector is coupled to the header connector, and the mating connector may be terminated to an end of one or more cables, or alternatively, to a substrate, such as a circuit board. The connectors include one or more circular inner conductors coaxially housed within a corresponding circular outer conductor.

Conventional coaxial cable connectors are not without their disadvantages. For instance, the inner and outer conductors are circular and are expensive to manufacture. For example, the conductors are screw machined, which is expensive and time consuming. Some known conductors are stamped and formed into a barrel or circular shape; however such conductors have poor electrical performance at higher frequencies.

A need remains for cost effective, high volume connector system that provides high-speed signal transmission while maintaining signal integrity.

BRIEF DESCRIPTION OF THE INVENTION

In an embodiment a coaxial connector system is provided. The coaxial connector system has a first coaxial connector having a first center contact and at least one outer contact segment. The coaxial connector system includes a second coaxial connector mated with the first coaxial connector. The second coaxial connector has a second center contact terminated to the first rectangular center contact. The second coaxial connector has at least one outer contact segment mechanically and electrically connected to the at least one outer contact segment of the first coaxial connector. The at least one outer contact segment of the first coaxial connector and the at least one outer contact segment of the second coaxial connector forma rectangular shaped outer contact box that peripherally surrounds the first and second center contacts.

In another embodiment, the coaxial connector system has a first coaxial connector having a first center contact having four side walls. The first coaxial connector has two outer contact segments located on different sides of the first center contact. Each outer contact segment of the first coaxial connector has a first wall and a second wall perpendicular to the first wall. The coaxial connector system includes a second coaxial connector having a second center contact with a socket having socket walls on four sides. The first center contact is received in the socket such that at least two of the sides of the first center contact engage corresponding socket walls of the second center contact. The second coaxial connector has two outer contact segments located on different sides of the second center contact. Each of the outer contact segments of the second coaxial connector has a first wall and a second wall perpendicular to the first wall. The outer contact segments of the first coaxial connector are electrically coupled to the outer contact segments of the second coaxial connector. The outer contact segments of the first and second connectors peripherally surround the center contacts of the first and second coaxial connectors.

DETAILED DESCRIPTION OF THE INVENTION

Figure 1:
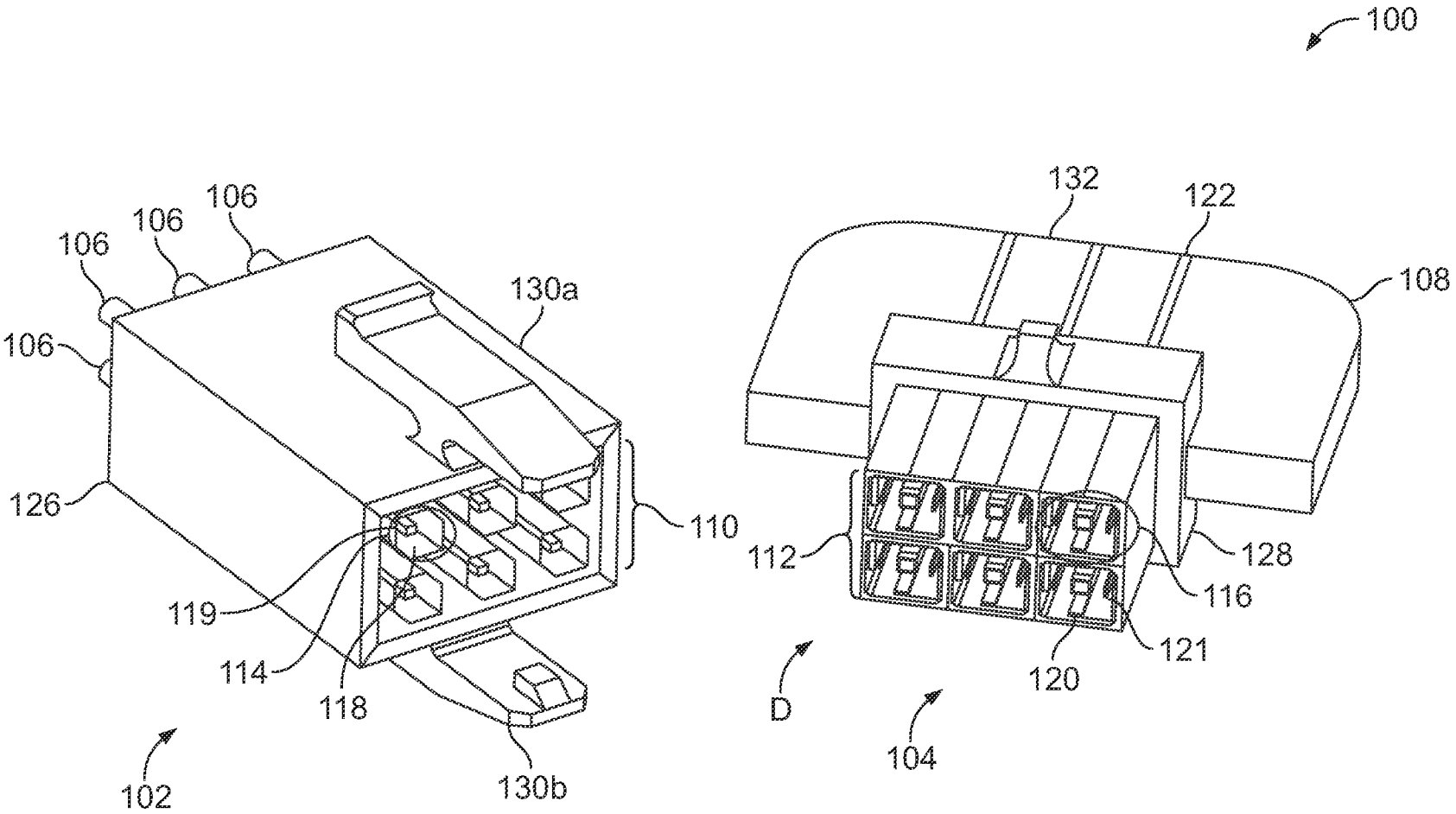
FIG. 1 illustrates a coaxial connector system formed in accordance with an exemplary embodiment.

Coaxial connector systems are illustrated and described herein having different parts and components. The parts and components may have common features, sizes, and shapes such that the parts and components are interchangeable. For example, the various connectors described herein are interchangeable and backwards compatible with other connectors from other systems. The various connectors define interchangeable modules that have different degrees of ruggedness or robustness and/or different degrees of electrical performance, such as bandwidth or data rate.

The various connectors of the connector systems illustrated and described herein generally represent connector assemblies, which include more than one individual connector. The connector assemblies are grouped together as a unit for simultaneously mating with corresponding connector assemblies. The individual connectors may be ganged together and mounted to a circuit board as a unit, or alternatively, may be individually mounted to the circuit board, and then the assembly and circuit board mounted to the corresponding connector assembly as a unit. In exemplary embodiments, the individual connectors are symmetrically designed such that the connectors may be utilized in more than one orientation, such as in 180° orientations. The connectors may be designed to have mechanical and/or electrical reversibility to the circuit board and/or to the corresponding mating half. As such, manufacturing may be simplified. Additionally, assembly may be simplified. Furthermore, part count may be reduced and total product count may be reduced. Optionally, the various connectors may represent end modules that may be provided at one end or the other end of the connector assembly. In exemplary embodiments, the connector may be used at either end. Alternatively, the connector may be designed to be either a right-end or a left-end module. Optionally, the various connectors may represent interior modules that may be used between designated end modules. In exemplary embodiments, the connector systems are expandable such that any number of connectors may be utilized, such as by adding additional interior modules, to achieve a desired configuration and number of contacts. Optionally, the various connectors may be useable as either end modules or interior modules.

The various connectors of the connector systems illustrated and described herein generally represent either header connectors or receptacle connectors. One or both of the connectors may be board-mounted connectors or alternatively, one or both of the connectors may be cable mounted rather than board mounted. Optionally, one mating half, such as the header connector, is mounted to a backplane, while the other mating half, such as the receptacle connector, is mounted to a daughtercard. Optionally, one mating half, such as the header connector, may constitute a vertical connector, where the contacts thereof pass straight through the connector, while the other mating half, such as the receptacle connector, may constitute a right-angle connector, where the contacts thereof are bent at 90° within the connector. Having one of the connectors as a right angle connector orients the circuit boards perpendicular to one another. Alternatively, both of the connectors may be right angle connectors such that the circuit boards are oriented parallel and/or coplanar with one another. Thus, multiple interfaces are provided. Additionally, the connectors may be edge mounted, surface mounted, press fit, edge launched, and/or the like.

FIG. 1 illustrates a coaxial connector system 100 formed in accordance with an exemplary embodiment. The coaxial connector system 100 includes a header assembly 102 and a receptacle assembly 104. The header assembly 102 and receptacle assembly 104 are configured to be mated together. In the illustrated embodiment, the header assembly 102 is cable mounted to corresponding cables 106. The cables 106 may terminate to any electrical device (not shown). In the illustrated embodiment, the receptacle assembly 104 is mounted to a circuit board 108. Alternative arrangements are possible in alternative embodiments. For example, the header assembly 102 may be board-mounted in alternative embodiments and/or the receptacle assembly 104 may be cable mounted in alternative embodiments. When the header assembly 102 is mated to the receptacle assembly 104, the header assembly 102 forms a mechanical and electrical connection with the receptacle assembly 104. In this manner, the header assembly 102 and the receptacle assembly 104 electrically connects the electrical device to the circuit board 108. Thus, the receptacle assembly 104 may be edge launched.

The header assembly 102 and the receptacle assembly 104 each include a plurality of coaxial connectors therein; however some embodiments may utilize an interface having a single coaxial connector. The header assembly 102 includes an array of coaxial connectors 110 and the receptacle assembly 104 includes a complementary array of coaxial connectors 112 configured to mate with the array of coaxial connectors 110. The coaxial connectors 110, 112 include several rectangular or boxed components (e.g. inner and outer conductors), rather than circular conductors of typical RF connector systems. In the illustrated embodiments, the arrays of coaxial connectors 110, 112 include six connectors distributed among two rows; however, in other embodiments, other arrangement with more or fewer connectors are possible in any number of rows and columns. FIG. 1 specifically identifies a first coaxial connector 114 of the array of coaxial connectors 110 and a second coaxial connector 116 of the array of coaxial connectors 112, which are configured to be mated together. Various features and components of the coaxial connectors 112, 114 will be described with specific reference to the first and second coaxial connectors 112, 114.

The first coaxial connector 114 has a generally rectangular shape with a rectangular first center contact 118 and a generally rectangular shaped first outer contact 119 that at least partially surrounds the first center contact 118. The first outer contact 119 is defined by at least one outer contact segment, as discussed below. In the illustrated embodiment, the first center contact 118 defines a rectangular or box pin; however other types of center contacts may be used in alternative embodiments, such as a socket. The second coaxial connector 116 has a generally rectangular shape with a complementary rectangular second center contact 120 and a generally rectangular shaped second outer contact 121 that at least partially surrounds the second center contact 120. The second outer contact 121 is defined by at least one outer contact segment, as discussed below. In the illustrated embodiment, the second center contact 120 defines a rectangular or boxed socket; however other types of center contacts may be used in alternative embodiments, such as a pin. The second center contact 120 is configured to be mated with, and form an electrical connection with, the first center contact 118 of the first coaxial connector 114. For example, the rectangular pin 118 is received in the boxed socket 120. As such, when the header assembly 102 is mated with the receptacle assembly 104, the first coaxial connector 114 mates with, and electrically connects to the second coaxial connector 116.

The first center contact 118 of the first coaxial connector 114 is electrically connected to one of the cables 106. Similarly, the second center contact 120 of the second coaxial connector 116 is electrically connected to a trace 122 of the circuit board 108. Accordingly, the center contacts 118, 120 electrically connect one of the cables 106 to the trace 122, but, other configurations are possible in other embodiments.

The first coaxial connector 114 and the second coaxial connector 116 are configured to mate with, and electrically connect with one another to from a RF rectangular contact assembly 124 (shown in FIG. 6; as discussed below). The rectangular shape of the contact assembly 124 allows a plurality of contact assemblies 124 to be placed adjacent to one another to increase the number of contact assemblies 124 in the arrays 110, 112 (for example, to increase the density of the coaxial connector system 100). Additionally, the rectangular shape of the RF rectangular contact assembly 124 lends itself to being stamped and formed from sheets of material, as opposed to the more costly screw machining. Additionally, being stamped and formed allows any shaped to be adapted (for example, right angle, vertical, varying height, and/or the like). Additionally, being stamped and formed allows the number of contact assemblies 124 in the arrays 110, 112 can be scaled (for example, for back plane applications having an M×N array).

The header assembly 102 and the receptacle assembly 104 include housings 126 and 128, respectively. The housing 126 holds the array of coaxial connectors 110. The housing 128 holds the array of coaxial connectors 112. The housings 126, 128 are configured to align and secure the arrays of coaxial connectors 110, 112 to one another. At least one of the housings 126, 128 may include a fastener, such as a latch, to secure the housings 126, 128 together. In the illustrated embodiment, the housing 126 includes latches 130*a* and 130*b* configured to secure the header assembly 102 to the receptacle assembly 104 when the header assembly 102 is inserted into the receptacle assembly 104. The latches 130*a* attaches to a catch 132 on the housing 128 when the header assembly 102 is inserted into the receptacle assembly 104 along a mating direction D. The second latch 130*b* is configured to mate with a second catch (not shown) on the housing 128. Accordingly, after the latch 130*a* engages the catch 132, the header assembly 102 cannot be inadvertently disengaged from the receptacle assembly 104 without releasing the latch 132. In other embodiments, other fasteners may be used in addition to, or in place of the latches 130 and the catches 132. For example, the housing 126, 128 may use a friction fit, one or more fasteners (for example a threaded fastener such as a thumb screw), and/or the like. Thus, the connector architecture is capable of utilizing any retention feature to ensure complete mating.

Figure 2:
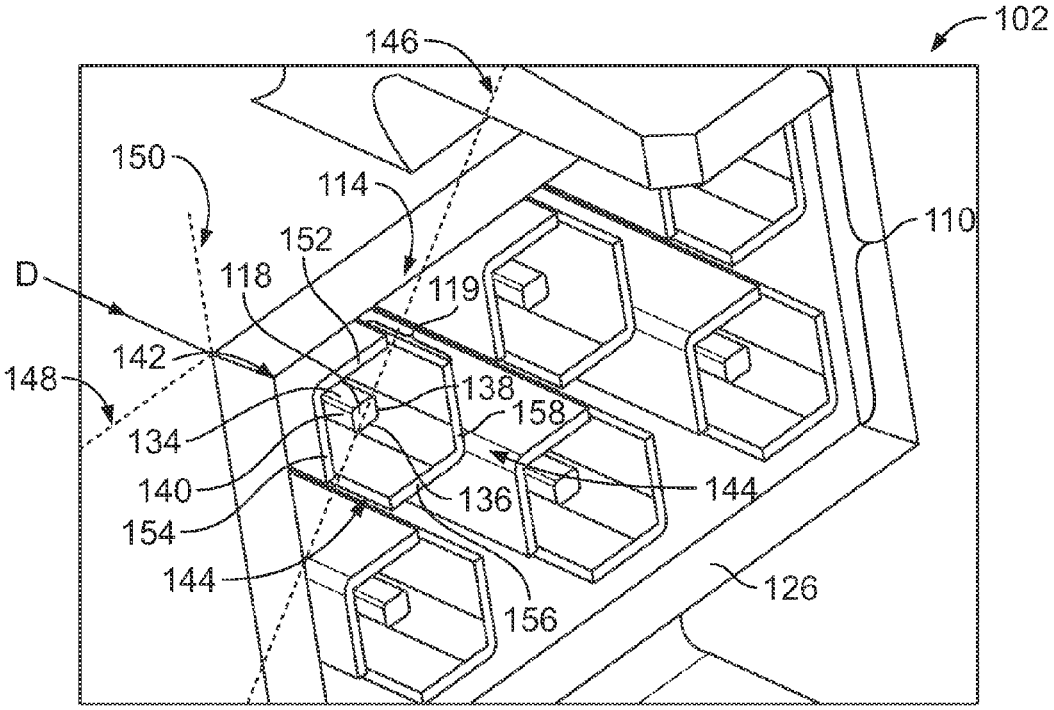
FIG. 2 is a perspective view of an array of coaxial connectors of a header assembly in accordance with an exemplary embodiment.

FIG. 2 is a perspective view of a portion of the header assembly 102, showing the array of coaxial connectors 110. The array of coaxial connectors 110 includes the first coaxial connector 114, and includes other coaxial connectors that are identical to the first coaxial connector 114.

The first coaxial connector 114 includes the first center contact 118. The first center contact 118 has four side walls 134, 136, 138, 140 that are substantially mutually orthogonal to one another such that the side walls 134-140 form a substantially square shaped cross-section. The first center contact 118 may be solid throughout (for example, the first center contact 118 may be extruded metal). The first center contact 118 may be formed of any suitable electrically conductive material such as, but not limited to, a metal such as copper, gold, and/or the like. The first center contact 118 may be selectively plated, such as on mating surfaces thereof.

The first outer contact 119 includes at least at one outer contact segment. In the illustrated embodiment, the first outer contact 119 includes a first outer contact segment 142 and a second outer contact segment 144 peripherally surrounding the first center contact 118. The outer contact segments 142, 144 define at least portions of a generally box-shaped shield structure surrounding the first center contact 118. The outer contact segments 142, 144 cooperate with the second outer contact 121 (shown in FIG. 1) to entirely peripherally surround the first center contact 118, as described in further detail below. The two outer contact segments 142, 144 are located on different sides of the first center contact 118. The first outer contact segment 142 and the second outer contact segment 144 are symmetrical about a diagonal axis 146 that is a transverse to a lateral axis 148 and a longitudinal axis 150. The lateral and longitudinal axes 148, 150, respectively are both perpendicular to the mating direction D and extend along the face of the housing 126.

Each of the outer contact segments 142, 144 have mutually perpendicular walls. The first outer contact segment 142 has a first wall 152 that is substantially perpendicular to a second wall 154. Similarly, the second outer contact segment 144 has a first wall 156 that is substantially perpendicular to a second wall 158. The first walls 152, 156 are substantially parallel to one another and extend in the direction of the lateral axis 148. The second walls 154, 158 are substantially parallel to one another and extend in the direction of a longitudinal axis 150. The walls 152-158 may be selectively sized and shaped to at least partially surround the first center contact 118. The walls 152-158 provide physical shielding of the first center contact 118, such as to block inadvertent touching of the first center contact 118 to prevent damage to the first center contact 118. The walls 152-158 provide electrical shielding of the first center contact 118. In an exemplary embodiment, the walls 152-158 provide electrical shielding on all four sides of the first center contact 118. The outer contact segments 142, 144 are separated from the center contact 118 by air. No dielectric spacer is positioned therebetween. Thus, in various embodiments, solely an air dielectric is provided with no reliance on other material for lead in, support, alignment, shielding, and/or the like.

Figure 3:
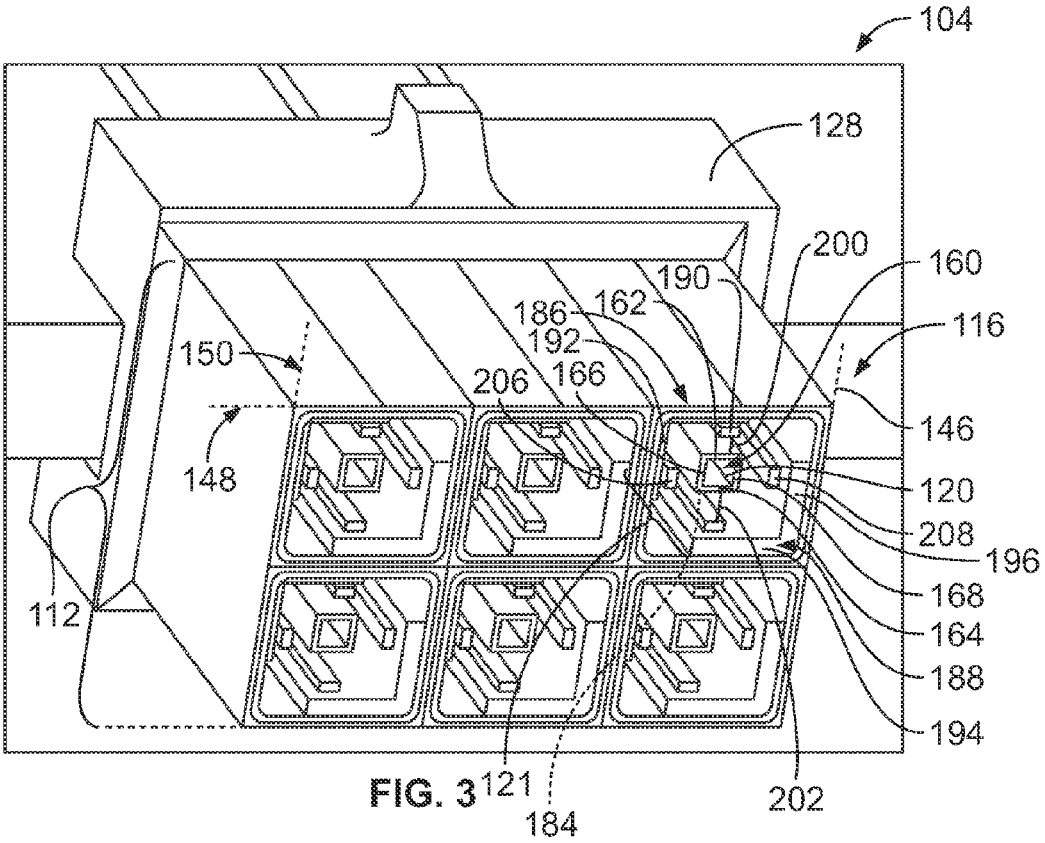
FIG. 3 is a perspective view of an array of coaxial connectors of a receptacle assembly in accordance with an exemplary embodiment.

FIG. 3 is a perspective view of the array of coaxial connectors 112 of the receptacle assembly 104. The array of coaxial connectors 112 includes the second coaxial connector 116, and may include other coaxial connectors that are identical to the second coaxial connector 112.

The second coaxial connector 116 includes the second center contact 120. The second center contact 120 includes a socket 160 configured to receive the first center contact 118 (shown in FIG. 2) of the first coaxial connector 114 (shown in FIG. 2). The socket 160 is formed by four socket walls 162, 164, 166, 168 that define the second center contact 120. The socket walls 162-168 are substantially mutually orthogonal to one another such that the socket walls 162-168 have a substantially square shaped cross-section. The second center contact 120 may be stamped and formed from one piece of metal material, such as, but not limited to, a metal such as copper, gold, and/or the like. The second center contact 120 may be selectively plated, such as on mating surfaces thereof.

Figure 4:
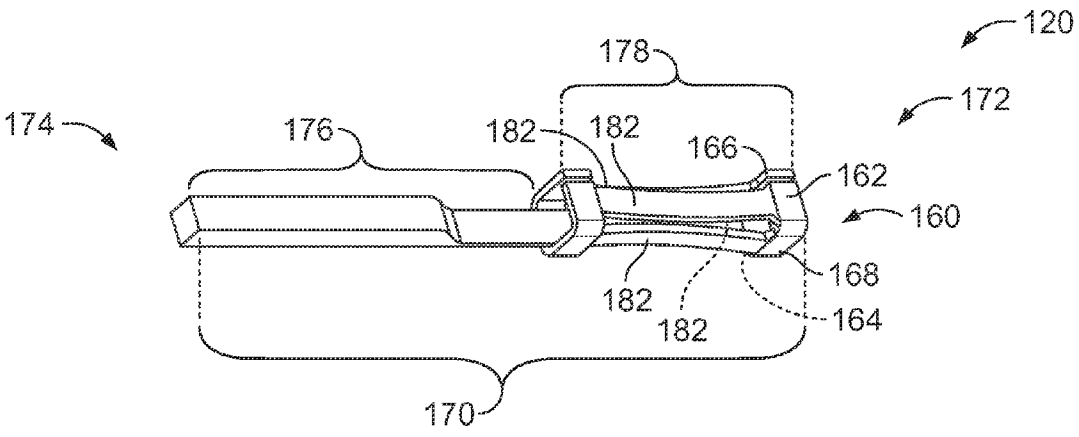
FIG. 4 is a side perspective view of a center contact in accordance with an exemplary embodiment.

FIG. 4 is a side perspective view of the second center contact 120. The second center contact 120 is generally box shaped having a body 170 extending between a mating end 172 and a mounting end 174. The second center contact 120 has a base 176 and a contact tail 178 extending from the base 176 to the mating end 172. The base 176 is generally flat. The contact tail 178 is generally box shaped and defines the socket 160. Optionally, during manufacture and/or assembly, the housing 128 (shown in FIG. 1) is overmolded over a portion of the base 176. The base 176 is configured to be terminated to the circuit board 108 (shown in FIG. 1) to electrically connect the second center contact 120 to the circuit board 108. For example, the base 176 may be spring biased against the circuit board 108, soldered to the circuit board 108, press-fit into a via in the circuit board 108, or otherwise terminated to the circuit board 108. The base 176 and the contact tail 178 are integrally formed with one another as a unitary one-piece structure. Thus, the second center contact 120 provides a four beam symmetrical stamped and formed contact.

The contact tail 178 defines the socket 160 at the mating end 172 and is configured to receive the first center contact 118 (shown in FIG. 2). The four socket walls 162-168 each include a corresponding spring beam 182 defining a tapered region configured to receive and engage at least two corresponding side walls 134-140 (shown in FIG. 2) of the first center contact 118. As such, the first center contact 118 provides a shaped pin to conform to the second center contact 120 in a wedge fashion. The spring beams 182 provide an electrical and mechanical connection between the socket walls 162-168 and the side walls 134-140 of the first center contact 118 by engaging at least two opposite side walls 134-140 with a spring-loaded fit. In the illustrated embodiment, each of the socket walls 162-168 include the spring beams 182. However, in other embodiments, only two opposite socket walls 162-168 may include the spring beams 182 and engage the first center contact 118.

Returning to FIG. 3, the housing 128 includes a compartment 184 that houses the second coaxial connector 116. The housing 128 may include several other compartments that hold the individual connectors 112 in the array.

The second outer contact 121 includes at least one outer contact segment. In the illustrated embodiment, the second outer contact 121 includes a first outer contact segment 186 and a second outer contact segment 188 peripherally surrounding the second center contact 120. The outer contact segments 186, 188 are configured to mechanically and electrically engage the outer contact segments 142, 144 (shown in FIG. 2) of the first coaxial connector 114 (shown in FIG. 2). The two outer contact segments 186, 188 are located on different sides of the second center contact 120. The outer contact segments 186, 188 define at least portions of a generally box-shaped shield structure surrounding the second center contact 120. The outer contact segments 186, 188 cooperate with the outer contact segments 142, 144 of the first outer contact 119 (shown in FIG. 2) to entirely peripherally surround the second center contact 120.

Each of the outer contact segments 186, 188 have mutually perpendicular walls. The first outer contact segment 186 has a first wall 190 that is substantially perpendicular to a second wall to 192. The second outer contact segment 188 has a first wall 194 that is substantially perpendicular to a second wall 196. The first walls 190, 194 are substantially parallel and extend in the direction of the lateral axis 148. The second walls 192,196 are substantially parallel and extend in the direction of the longitudinal axis 150. The walls 190-196 are selectively sized and shaped to at least partially surround the second center contact 120. The walls 190-196 provide physical shielding of the second center contact 120, such as to block inadvertent touching of the second center contact 120 to prevent damage to the second center contact 120. The walls 190-196 provide electrical shielding of the second center contact 120. In an exemplary embodiment, the walls 190-196 provide electrical shielding on all four sides of the second center contact 120. The outer contact segments 186, 188 are separated from the center contact 120 by air. No dielectric spacer is positioned therebetween.

The second coaxial connector 116 includes one or more sets of grounding beams configured to mechanically and electrically engage the outer contact segments 142, 144 (shown in FIG. 2) of the first coaxial connector 114 (shown in FIG. 2). The grounding beams provide fingered ground contacts. The second coaxial connector 116 includes a first set of grounding beams having a first grounding beam 200 diametrically opposed on an opposite side of the second center contact 120 to a second grounding beam 202. In the illustrated embodiment, the second coaxial connector 116 includes a second set of grounding beams having a first grounding beam 206 diametrically opposed on an opposite side of the second center contact 120 to a second grounding beam 208. The first and second set of grounding beams are nearly orthogonal to one another. The grounding beams 200, 202, 206, 208 peripherally surround the second center contact 120.

The grounding beams 200, 202, 206, 208 are positioned within the compartment 184 generally equidistant from the second center contact 120, such as to control the impedance, such as for impedance matching, such as to 85 Ohms, 100 Ohms or to another value. The grounding beam 200 is situated between the wall 162 of the socket 160 and the wall 190 of the first outer contact segment 186. The grounding beam 202 is situated between the wall 164 of the socket 160 and the wall 194 of the second outer contact segment 188. The grounding beam 206 of the second set is situated between the wall 166 of the socket 160 and the wall 192 of the second outer contact 188. The grounding beam 208 of the second set is situated between the wall 168 of the socket 160 and the wall 196 of the second outer contact segment 188.

The grounding beams 200, 202, 206, 208 are selectively spaced apart from the second center contact 120. Specifically, the first beam 200 includes an offset distance X from the wall 162 of the socket 160. The second beam 202 is offset the distance X from the wall 164 of the socket 160. In this manner, the first set of grounding beams 200, 202 are offset an equal distance X from the socket 160. Similarly, the grounding beams 206, 208 of the second set are offset the distance X from the socket 160. The offset distance X is selectively chosen to control an electrical characteristic associated with the coaxial connector system 100 (shown in FIG. 1). For example, an electrical characteristic may include an impedance, a capacitance, and/or an inductance. For example, increasing the offset distance X allows for an additional amount of air between the second center contact 120 and the grounding beams 200, 202, 206, 208 which may affect the impedance of the RF rectangular contact assembly 124 (shown in FIG. 6).

Figure 5:
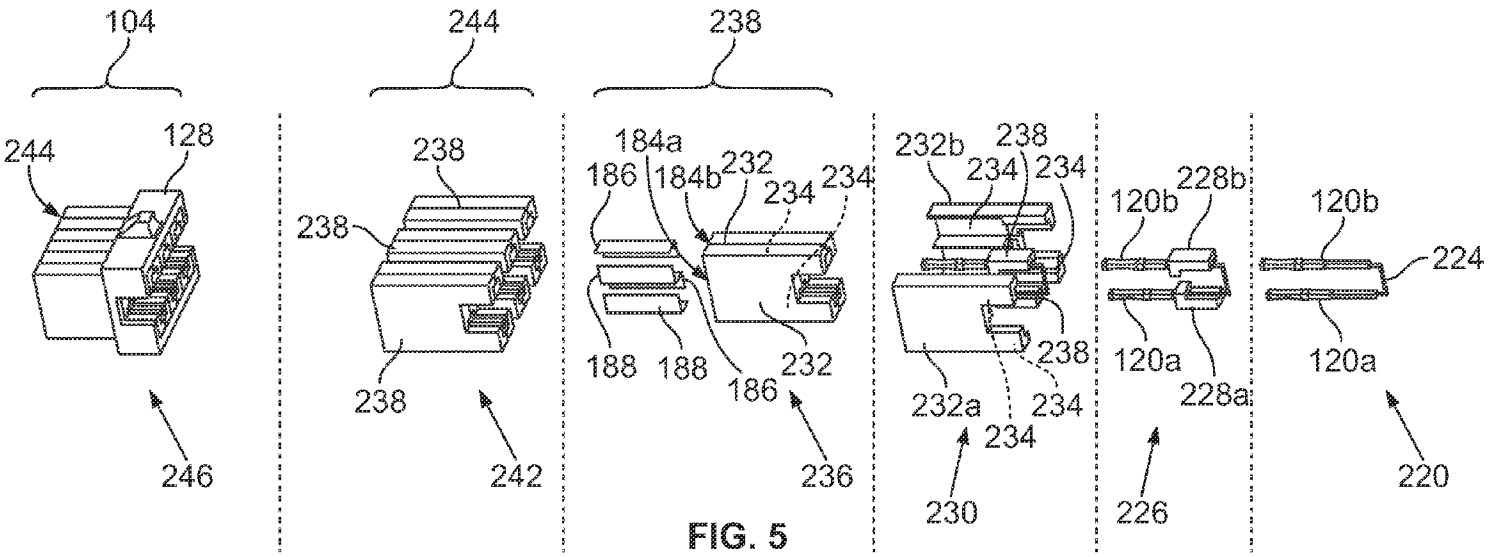
FIG. 5 illustrates a manufacturing process for a receptacle assembly showing several stages of manufacture that may be used to assembly a receptacle assembly.

FIG. 5 illustrates a manufacturing process for the receptacle assembly 104 showing several stages of manufacture, generally identified at 220, 226, 230, 236, 242, and 246 that may be used to assembly the receptacle assembly 104.

The assembly begins with a stamping and forming stage 220. In the stamping and forming stage 220, a pair of the center contacts 120 are provided. The pair of center contacts 120*a* and 120*b* are joined by a carrier 224. The carrier 224 holds the center contacts 120 together during assembly and is later removed.

Next, in a molding stage 226, the center contacts 120*a* and 120*b* are each overmolded with dielectric support bodies 228*a* and 228*b*, respectively. The dielectric support bodies 228 extend over a portion of the contact base 176 (shown in FIG. 4) of each center contact 120. For example, the dielectric support bodies 228 may be strip line overmolded over the center contacts 120 and/or may be configured for manufacturing using strip line molding.

Next, in a holder pre-assembly stage 230, a pair of holder members 232*a* and 232*b* are provided. The holder members 232 include channels 234 therein selectively sized and shaped to hold the dielectric support bodies 228. for example, the holder members 232 may create a clam-shell. The channels 234 provide initial alignment of the center contacts 120. The holder members 232 may be conducive and may provide a ground or electrical reference for the receptacle assembly 104. The holder members 232 may be comprised of any electrically conductive material. For example, the holder members 232 may be made of a metal material or may be a plastic material that is metalized or plated (for example, plated plastic). Thus, the holder members 232 may provide RF shielding of the center contacts 120. Additionally, the holder members 232 may provide heat dissipation. The holder members 232 may electrically terminate to the circuit board 108.

Next, in a holder assembly stage 236, the holder members 232 are joined together to form a contact module 238. The holder members 232 may be secured to one another using any means commonly used for joining housings, such as, for example, a snap fit, a friction fit, through the use of an adhesive, a fastener, and/or the like. Once the holder members 232 are joined, the carrier 224 is removed from the center contacts 120. The channels 234 in the holder members 232 create the compartments 184*a* and 184*b* in the contact module 238. The first and second outer contact segments 186, 188, respectively are inserted into the compartments 184 through the front. For example, a pair of the first and second outer contact segments 186, 188 are inserted into the compartment 184*a*, and another pair of the first and second outer contact segments 186, 188 are inserted into the compartment 184*b*.

Next, in a module build-up stage 242, a plurality of contact modules 238 are assembled to from a module stack 244. In the illustrated embodiment, three contact modules 238 are shown, however, in other embodiments, more or fewer contact modules 238 may be used. The contact modules 238 may be secured to one another using any means commonly used for the joining housings, such as, for example, a snap fit, a friction fit, through the use of an adhesive, a fastener, and/or the like.

Next, in a final assembly stage 246, the module stack 244 is loaded into the housing 128 to form the receptacle assembly 104. The housing 128 holds the module stack 244 together.

The housing 128 is selectively sized and shaped to provide a fiction fit with the module stack 244.

It should be noted that the above described embodiment is for example only. The various components may include more or fewer sub-components. For example, in the stamping and forming stage 220, the illustrated embodiment shows a pair of center contacts 120. However, in other embodiments, more or fewer center contacts 120 may be used. For example, 4, 8, 16, or any other number of contacts 120 may be used. In the illustrated embodiment, several stages are shown, however, in other embodiments, more or fewer stages may be used. For example, one or more of the stages 220, 226, 230, 236, 242 may be combined. Although, only assembly of the receptacle assembly 104 is illustrated, the header assembly 102 (shown in FIG. 1) may be assembled in a similar manner.

Figure 6:
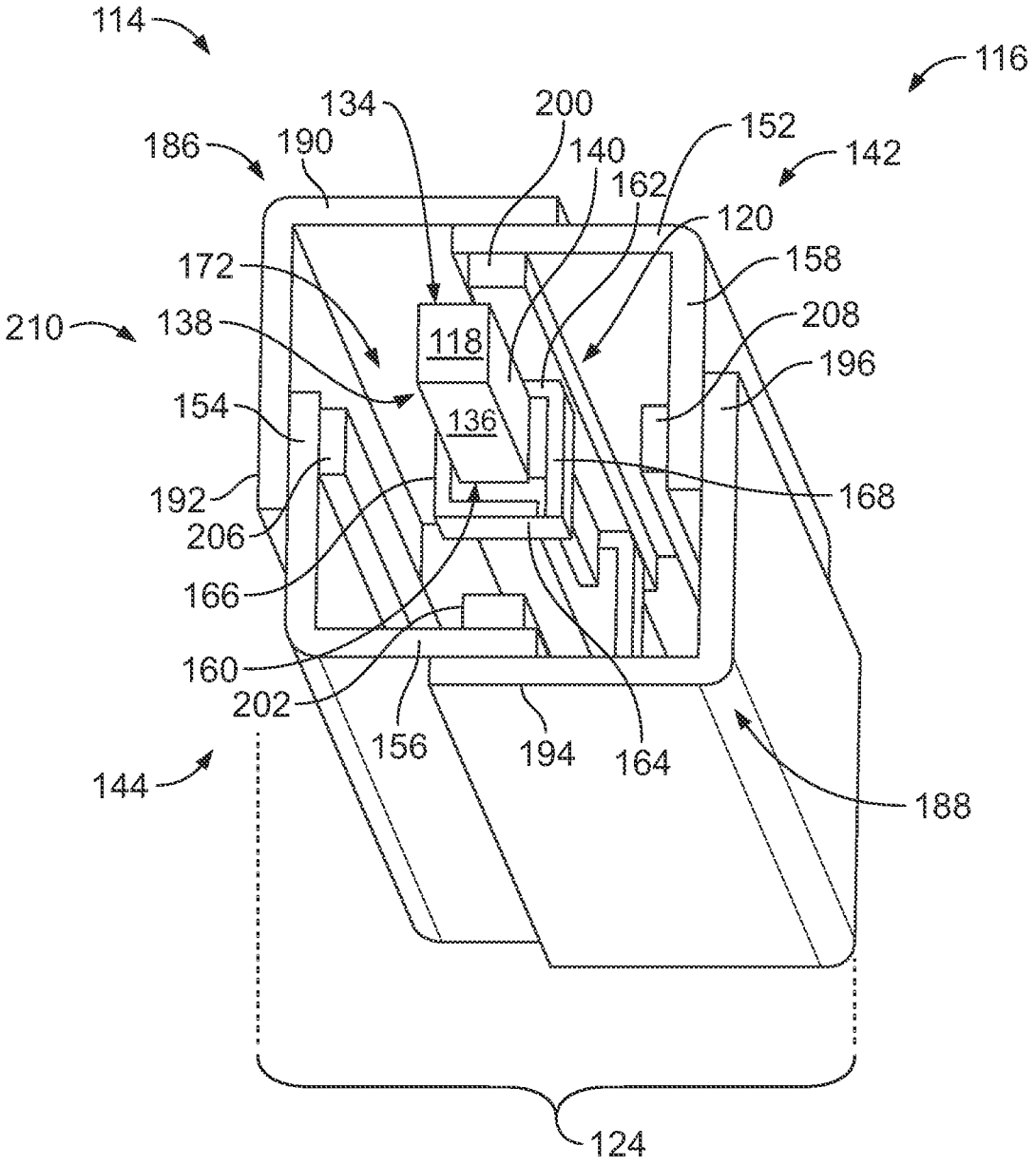
FIG. 6 is a cross-sectional perspective view of a first coaxial connector mated with a second coaxial connector in accordance with an exemplary embodiment.

FIG. 6 is a cross-sectional perspective view of the RF rectangular contact assembly 124 showing the first and second connectors 114, 116 mated together with the housings removed. When the first coaxial connector 114 is mated with the second coaxial connector 116, the first and second connectors 114, 116 constitute the RF rectangular contact assembly 124. The RF rectangular contact assembly 124 provides shielding from interference, such as electromagnetic interference (EMI), electrostatic discharge (ESD), cross-talk, and/or the like. The RF rectangular contact assembly 124 also allows multiple points of electrical contact between the first coaxial connector 114 and the second connector 116. Accordingly, the RF rectangular contact assembly 124 provides an integrated connector design. As such, the RF rectangular contact assembly 124 allows high-speed communication with reduced signal degradation.

As shown in the illustrated embodiment, the second coaxial connector 116 is mated with the first coaxial connector 114. When mated, the second center contact 120 engages and terminates to the first center contact 118. The first center contact 118 forms an electrical and mechanical connection with the second center contact 120. The first center contact 118 is received in the socket 160 through the mating end 172 (also shown in FIG. 4) of the second center contact 120. In the illustrated embodiment, the socket walls 162-168 engage the side walls 134-140 of the first center contact 118, thus providing multiple points of contact therebetween. In other embodiments, at least two of the sides of the first center contact 118 engage corresponding socket walls of the second center contact 120.

At least one of the outer contact segments 142, 144 of the first coaxial connector 114 engage at least one of the outer contact segments 186, 188 of the second coaxial connector 116 to create a rectangular shaped outer contact box 210 that peripherally surrounds the first and second center contacts 118, 120. The outer contact segments 142, 144 of the first coaxial connector 114 abut against and are electrically coupled to the outer contact segments 186, 188 of the second coaxial connector 116. Each of the outer contact segments 142, 144, 186, 188 may be L shaped to provide protection to unmated center contacts 118, 120 and provide alignment of the center contacts 118, 120. The rectangular shaped outer contact box 210 peripherally surrounds the first and second center contacts 118, 120 such that no gaps exist between the outer contact segments 142, 144, 186, 188. For example, the outer contact box 210 provides 360° shielding around the center contacts 118, 120. The outer contact box 210 provides electromagnetic shielding for the coaxial connector assembly 124 by circumferentially surrounding the first and second center contacts 118, 120. The outer contact box 210 provides a symmetrical enclosure for the first and second center contacts 118, 120.

The grounding beams 200, 202, 206, 208 mechanically and electrically engage with the outer contact segments 142, 144 of the first coaxial connector 114. The grounding beam 200 abuts against wall 152 of the first outer contact segment 142. The grounding beam 202 abuts against the wall 156 of the second outer contact segment 144. The grounding beam 206 abuts against the wall 154 of the second outer contact segment 144. The grounding beam 208 abuts against the wall 158 of the first outer contact segment 142.

The grounding beams 200, 202, 206, 208 are configured to provide alignment of the first and second coaxial connectors 114, 116 by limiting movement of the first and second outer contact segments 142, 144. The first walls 152, 156 of the first coaxial connector 114 are held between the grounding beams 200, 202 and the first walls 190, 194 of second coaxial connector 116, respectively. The second walls 154, 158 of the first coaxial connector 114 are held between the grounding beams 206, 208 and the second walls 192, 196 of the second coaxial connector 116, respectively.

The grounding beams 200, 202, 206, 208 are electrically connected to the first and second outer contact segments 186, 188 of the second coaxial connector 116. The grounding beams 200, 202, 206, 208 and the walls 190-196 provide an electrical connection with the walls 152-158 of the first coaxial connector 114. In this manner, multiple electrical contact points are provided thereby allowing the RF rectangular contact assembly 124 to maintain electrical contact in moving or vibrating environments by maintaining electrical contact between at least one of the grounding beams 200, 202, 206, 208 and the walls 152-158 and between at least one of the walls 190-196 and the walls 152-158.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A coaxial connector system comprising:

a first coaxial connector having a rectangular first center contact with four sides and at least one outer contact segment that peripherally surrounds the first center contact on at least two of the respective four sides;

a second coaxial connector mated with the first coaxial connector, the second coaxial connector having a rectangular second center contact with four sides that is terminated to the first center contact, the second coaxial connector having at least one outer contact segment that peripherally surrounds the second center contact on at least two of the respective four sides, the at least one outer contact segment of the second coaxial connector being mechanically and electrically connected to the at least one outer contact segment of the first coaxial connector to form a rectangular shaped outer contact box peripherally surrounding a perimeter of the first and second center contacts, wherein the at least one outer contact segment of the first coaxial connector defines a first segment of the outer contact box that surrounds a first portion of the perimeter of the first and second center contacts, and the at least one outer contact segment of the second coaxial connector defines a second segment of the outer contact box that surrounds a different, second portion of the perimeter of the first and second center contacts.

2. The coaxial connector system of claim 1, wherein the first coaxial connector includes a first outer contact segment and a second outer contact segment that are spaced apart from one another and extend peripherally along different portions of the first center contact of the first coaxial connector.

3. The coaxial connector system of claim 1, wherein the second coaxial connector includes a first outer contact segment and a second outer contact segment that are spaced apart from one another and extend peripherally along different portions of the second center contact of the second coaxial connector.

4. The coaxial connector system of claim 1, wherein the second center contact of the second coaxial connector defines a socket that is configured to receive the first center contact of the first coaxial connector, the socket having a tapered region defined by at least one spring beam, the at least one spring beam providing an electrical and mechanical connection between the first center contact and the socket.

5. The coaxial connector system of claim 1, wherein the second center contact of the second coaxial connector includes a socket at a mating end configured to receive the first center contact of the first coaxial connector and engage four different sides of the first center contact.

6. The coaxial connector system of claim 1, wherein the at least one outer contact segment of the first coaxial connector includes a first outer contact segment and a second outer contact segment that are spaced apart from one another and are symmetrical about a diagonal axis.

7. The coaxial connector system of claim 1, wherein the at least one outer contact segment of the first coaxial connector mechanically and electrically connects to the at least one outer contact segment of the second coaxial connector such that no gaps exist between the at least one outer contact segment of the first coaxial connector and the at least one outer contact segment of the second coaxial connector and the outer contact box that is formed provides 360° shielding around the first and second center contacts.

8. The coaxial connector system of claim 1, wherein each outer contact segment of the first coaxial connector peripherally surrounds the first center contact on at least two but less than all four of the respective sides, and each outer contact segment of the second coaxial connector peripherally surrounds the second center contact on at least two but less than all four of the respective sides.

9. The coaxial connector system of claim 1, wherein the second coaxial connector includes grounding beams situated between the second center contact and the outer contact box formed by the connection between the at least one outer contact segment of the first coaxial connector and the at least one outer contact segment of the second coaxial connector, the grounding beams mechanically and electrically engaging the at least one outer contact segment of the first coaxial connector.

10. The coaxial connector system of claim 9, wherein opposing pairs of the grounding beams are positioned equidistant from opposite sides of the second center contact.

11. The coaxial connector system of claim 10, wherein an offset distance between the grounding beams and the second center contact is selectively sized to control an impedance of the coaxial connector system.

12. The coaxial connector system of claim 9, wherein the grounding beams are integral with the at least one outer contact segment of the second coaxial connector.

13. A coaxial connector system comprising:

a first coaxial connector having a first center contact having four side walls, the first coaxial connector having two outer contact segments spaced apart from one another around the first center contact, each outer contact segment having an L-shape with a vertical wall and a horizontal wall perpendicular to the vertical wall, the vertical and horizontal walls of each outer contact segment extending along different sides of the first center contact;

a second coaxial connector having a second center contact defining a socket having socket walls on four sides, the first center contact being received in the socket such that at least two of the side walls of the first center contact engage corresponding socket walls of the second center contact, the second coaxial connector having two outer contact segments spaced apart from one another around the second center contact, each outer contact segment having an L-shape with a vertical wall and a horizontal wall perpendicular to the vertical wall, the vertical and horizontal walls of each outer contact segment extending along different sides of the second center contact;

wherein each of the two outer contact segments of the first coaxial connector is mechanically and electrically coupled to both of the outer contact segments of the second coaxial connector to form a rectangular shaped outer contact box that peripherally surrounds the first and second center contacts.

14. The coaxial connector system of claim 13, wherein the second coaxial connector includes multiple grounding beams, each grounding beam disposed between the second center contact and one of the two outer contact segments of the second coaxial connector, each grounding beam spaced apart from the corresponding outer contact segment by a gap, each gap receiving one of the vertical wall or the horizontal wall of one of the two outer contact segments of the first coaxial connector therein such that the vertical wall or the horizontal wall mechanically engages and is held between the corresponding ground beam and the corresponding outer contact segment of the second coaxial connector.

15. The coaxial connector system of claim 14, wherein the grounding beams are equidistant from the second center contact.

16. The coaxial connector system of claim 13, wherein the outer contact segments of the first and second coaxial connectors are symmetrical about a lateral axis of symmetry.

17. The coaxial connector system of claim 13, wherein the socket of the second center contact includes a tapered region configured to receive and engage at least two sides of the first center contact and provide an electrical and mechanical connection therebetween.

18. The coaxial connector system of claim 13, wherein the vertical wall of a first of the two outer contact segments of the first coaxial connector engages the vertical wall of a first of the two outer contact segments of the second coaxial connector and the horizontal wall of the first outer contact segment of the first coaxial connector engages the horizontal wall of a second of the two outer contact segments of the second coaxial connector.

19. The coaxial connector system of claim 13, wherein the two outer contact segments of the second coaxial connector include a first outer contact segment and a second outer contact segment, the first outer contact segment defining a top-left corner of the outer contact box that is formed by the connection between the outer contact segments of the first and second coaxial connectors, the second outer contact segment defining a bottom-right corner of the outer contact box, and wherein the two outer contact segments of the first coaxial connector include a first outer contact segment and a second outer contact segment, the first outer contact segment defining a bottom-left corner of the outer contact box, the second outer contact segment defining a top-right corner of the outer contact box.

20. The coaxial connector system of claim 19, wherein the second coaxial connector includes a top grounding beam, a bottom ground beam, a left grounding beam, and a right grounding beam, wherein the vertical wall of the first outer contact segment of the first coaxial connector is held between the left grounding beam and the vertical wall of the first outer contact segment of the second coaxial connector, and the horizontal wall of the first outer contact segment of the first coaxial connector is held between the bottom grounding beam and the horizontal wall of the second outer contact segment of the second coaxial connector, and wherein the vertical wall of the second outer contact segment of the first coaxial connector is held between the right grounding beam and the vertical wall of the second outer contact segment of the second coaxial connector, and the horizontal wall of the second outer contact segment of the first coaxial connector is held between the top grounding beam and the horizontal wall of the first outer contact segment of the second coaxial connector.

* * * * *